US008735810B1

(12) United States Patent
Vestal

(10) Patent No.: US 8,735,810 B1
(45) Date of Patent: May 27, 2014

(54) TIME-OF-FLIGHT MASS SPECTROMETER WITH ION SOURCE AND ION DETECTOR ELECTRICALLY CONNECTED

(71) Applicant: Marvin L. Vestal, Framingham, MA (US)

(72) Inventor: Marvin L. Vestal, Framingham, MA (US)

(73) Assignee: Virgin Instruments Corporation, Sudbury, MA (US)

( * ) Notice: Subject to any disclaimer, the term of this patent is extended or adjusted under 35 U.S.C. 154(b) by 0 days.

(21) Appl. No.: 13/938,185

(22) Filed: Jul. 9, 2013

Related U.S. Application Data

(60) Provisional application No. 61/792,083, filed on Mar. 15, 2013.

(51) Int. Cl.
*H01J 49/00* (2006.01)

(52) U.S. Cl.
USPC ..... 250/286; 250/281; 250/282; 250/287; 250/288

(58) Field of Classification Search
USPC ..... 250/281, 282, 286–288
See application file for complete search history.

(56) References Cited

U.S. PATENT DOCUMENTS

| | | | | |
|---|---|---|---|---|
| 4,960,992 | A | 10/1990 | Vestal et al. | |
| 5,087,815 | A | 2/1992 | Schultz et al. | |
| 5,144,127 | A | 9/1992 | Williams et al. | |
| 5,160,840 | A | 11/1992 | Vestal | |
| 5,166,518 | A | 11/1992 | Freedman | |
| 5,510,613 | A * | 4/1996 | Reilly et al. | 250/287 |
| 5,625,184 | A | 4/1997 | Vestal et al. | |
| 5,627,369 | A | 5/1997 | Vestal et al. | |
| 5,847,385 | A | 12/1998 | Dresch | |
| 6,057,543 | A | 5/2000 | Vestal et al. | |
| 6,300,627 | B1 | 10/2001 | Koster et al. | |
| 6,489,610 | B1 | 12/2002 | Barofsky et al. | |
| 6,512,225 | B2 * | 1/2003 | Vestal et al. | 250/287 |
| 6,534,764 | B1 | 3/2003 | Verentchikov et al. | |
| 6,621,074 | B1 | 9/2003 | Vestal | |
| 6,872,941 | B1 | 3/2005 | Whitehouse et al. | |

(Continued)

FOREIGN PATENT DOCUMENTS

| | | | |
|---|---|---|---|
| WO | 00-77823 | A2 | 12/2000 |
| WO | 2004-030025 | A1 | 4/2004 |
| WO | 2006-064280 | A2 | 6/2006 |
| WO | 2010-138781 | A2 | 12/2010 |

OTHER PUBLICATIONS

"Notification Concerning Transmittal of International Preliminary Report on Patentability" for PCT/US2012/025761, Sep. 6, 2013, 6 pages, The International Bureau of WIPO, Geneva, Switzerland.

"Notification of Transmittal of the International Search Report and the Written Opinion of the International Searching Authority, or the Declaration" for PCT/US2013/028953, Jun. 27, 2013, 13 pages, Korean Intellectual Property Office, Daejeon Metropolitan City, Republic of Korea.

"Notification Concerning Transmittal of International Preliminary Report on Patentability" for PCT/US2011/063855, Jun. 27, 2013, 8 pages, The International Bureau of WIPO, Geneva, Switzerland.

(Continued)

*Primary Examiner* — Michael Maskell
(74) *Attorney, Agent, or Firm* — Kurt Rauschenbach; Rauschenbach Patent Law Group, LLC

(57) ABSTRACT

A time-of-flight mass spectrometer includes a sample plate that supports a sample for analysis. A pulsed ion source generates a pulse of ions from the sample positioned on the sample plate. An ion accelerator receives the pulse of ions generated by the pulsed ion source and accelerates the ions. An ion detector includes an input in a flight path of the accelerated ions emerging from the field-free drift space and an output that is electrically connected to the sample plate. The ion detector converts the detected ions into a pulse of electrons.

28 Claims, 6 Drawing Sheets

(56) References Cited

U.S. PATENT DOCUMENTS

| | | | | |
|---|---|---|---|---|
| 7,214,320 | B1 | 5/2007 | Gregori et al. | |
| 7,223,966 | B2 | 5/2007 | Weiss et al. | |
| 7,355,169 | B2 | 4/2008 | McLuckey et al. | |
| 7,498,588 | B1 | 3/2009 | Gordon et al. | |
| 7,564,026 | B2 * | 7/2009 | Vestal | 250/287 |
| 7,564,028 | B2 | 7/2009 | Vestal | |
| 7,589,319 | B2 | 9/2009 | Vestal | |
| 7,663,100 | B2 | 2/2010 | Vestal | |
| 7,667,195 | B2 | 2/2010 | Vestal | |
| 7,932,491 | B2 | 4/2011 | Vestal | |
| 2002/0158194 | A1 | 10/2002 | Vestal et al. | |
| 2003/0141447 | A1 | 7/2003 | Verentchikov et al. | |
| 2003/0180807 | A1 | 9/2003 | Hess et al. | |
| 2004/0119012 | A1 | 6/2004 | Vestal | |
| 2004/0203175 | A1 | 10/2004 | Li et al. | |
| 2004/0213721 | A1 | 10/2004 | Arno et al. | |
| 2005/0035285 | A1 | 2/2005 | Tan et al. | |
| 2005/0116162 | A1 | 6/2005 | Vestal | |
| 2005/0242279 | A1 | 11/2005 | Verentchikov | |
| 2005/0269505 | A1 | 12/2005 | Ermer | |
| 2005/0279933 | A1 | 12/2005 | Appelhans et al. | |
| 2006/0266941 | A1 | 11/2006 | Vestal | |
| 2008/0067349 | A1 | 3/2008 | Moskovets et al. | |
| 2008/0078931 | A1 | 4/2008 | Vestal et al. | |
| 2008/0272291 | A1 * | 11/2008 | Vestal | 250/287 |
| 2009/0294658 | A1 | 12/2009 | Vestal et al. | |
| 2010/0181473 | A1 | 7/2010 | Blenkinsopp et al. | |
| 2010/0276585 | A1 | 11/2010 | Lehmann | |
| 2010/0301202 | A1 | 12/2010 | Vestal | |
| 2011/0049350 | A1 | 3/2011 | Vestal | |
| 2011/0155901 | A1 | 6/2011 | Vestal | |
| 2011/0266431 | A1 | 11/2011 | Vestal | |
| 2012/0228490 | A1 * | 9/2012 | Wu et al. | 250/282 |

OTHER PUBLICATIONS

"Office Action" for U.S. Appl. No. 12/651,070, Dec. 9, 2011, 31 pages, United States Patent Office, Alexandria, VA, US.

"Office Action" for U.S. Appl. No. 12/651,070, May 24, 2011, 50 pages, United States Patent Office, Alexandria, VA, US.

"Office Action" for U.S. Appl. No. 12/968,254, May 14, 2012, 23 pages, United States Patent Office, Alexandria, VA, US.

"Notification of Transmittal of the International Search Report and the Written Opinion of the International Searching Authority, or the Declaration" for PCT/US2012/025761, Sep. 25, 2012, 9 pages, International Searching Authority/KR, Daejeon Metropolitan City, Republic of Korea.

"Notification of Transmittal of the International Search Report and the Written Opinion of the International Searching Authority, or the Declaration" for PCT/US2011/063855, Jul. 27, 2012, 11 pages, Intellectual Searching Authority/Korea, Korean Intellectual Property Office, Daejeon Metropolitan City, Republic of Korea.

"Notification Concerning Transmittal of International Preliminary Report on Patentability (Chapter I of the Patent Cooperation Treaty" for PCT/US2010/060902, Jul. 12, 2012, 7 pages, The International Bureau of WIPO, Geneva, Switzerland.

Beavis, Ronald C., et al., Factors Affecting the Ultraviolet Laser Desorption of Proteins, Rapid Communications in Mass Spectrometry, 1989, pp. 233-237, vol. 3 No. 9, Heyden & Son Limited.

Bergmann, T., et al., High-Resolution Time-Of-Flight Mass Spectrometer, Rev. Sci. Instrum., Apr. 1989, pp. 792-793, vol. 60, No. 4, American Institute of Physics.

Beussman, Douglas J., et al., Tandem Reflectron Time-Of-Flight Mass Spectrometer Utilizing Photodissociation, Analytical Chemistry, Nov. 1, 1995, pp. 3952-3957, vol. 67, No. 21, American Chemical Society.

Colby, Steven M., et al., Space-Velocity Correlation Focusing, Analytical Chemistry, Apr. 15, 1996, pp. 1419-1428, vol. 68, No. 8, American Chemical Society.

Cornish, Timothy J., et al., A Curved Field Reflectron Time-Of-Flight Mass Spectrometer for the Simultaneous Focusing of Metastable Product Ions, Rapid Communication in Mass Spectrometry, 1994 pp. 781-785, vol. 8, John Wiley & Sons.

Cornish, Timothy J., et al., Tandem Time-Of-Flight Mass Spectrometer, Analytical Chemistry, Apr. 15, 1993, pp. 1043-1047, vol. 65, No. 8.

Hillenkamp, F., Laser Desorption Mass Spectrometry: Mechanisms, Techniques and Applications, 1989, pp. 354-362, vol. 11A, Heyden & Son, London.

Kaufmann, R., et al., Mass Spectrometric Sequencing of Linear Peptides by Product-Ion Analysis in a Reflectron Time Of-Flight Mass Spectrometer Using Matrix Assisted Laser Desorption Ionization, Rapid Communications in Mass Spectrometry, 1993, pp. 902-910, vol. 7, John Wiley & Sons, Ltd.

Mamyrin, B.A. et al., The Mass-Reflectron, A New Nonmagnetic Time-Of-Flight Mass Spectrometer With High Resolution, Sov. Phys. 1973, pp. 45-48, vol. 37 No. 1, American Institute of Physics.

Matsuda, H., et al., Particle Flight Times Through Electrostatic and Magnetic Sector Fields and Quadrupoles to Second Order, International Journal of Mass Spectrometry and Ion Physics, 1982, pp. 157-168, vol. 42, Elsevier Scientific Publishing Company, Amsterdam, The Netherlands.

Neuser, H.J., et al., High-Resolution Laser Mass Spectrometry, International Journal of Mass Spectrometry and Ion Process, 1984, pp. 147-156, vol. 60, Elsevier Science Publishers B.V., Amsterdam, The Netherlands.

Vestal, M.L., et al. Delayed Extraction Matrix-Assisted Laser Desorption Time-Of-Flight Mass Spectrometry, Rapid Communications in Mass Spectrometry, 1995, pp. 1044-1050, vol. 9, John Wiley & Sons, Ltd.

Vestal, M.L., et al. Resolution and Mass Accuracy in Matrix Accuracy in Matrix-Assisted Laser Desorption Ionization-Time-Of-Flight, American Society for Mass Spectrometry, 1998, pp. 892-911, Elsevier Science, Inc.

Vestal, M., High Performance MALDI-TOF Mass Spectrometry for Proteomics, International Journal of Mass Spectrometry, 2007, pp. 83-92.

Wiley, W.C., et al., Time-Of-Flight Mass Spectrometer With Improved Resolution, The Review of Scientific Instruments, Dec. 1955, pp. 1150-1157, vol. 26, No. 13.

Zhou, J. Kinetic Energy Measurements of Molecular Ions Ejected Into an Electric Field by Matrix-Assisted Laser Desorption, Rapid Communications in Mass Spectrometry, Sep. 1992, pp. 671-678, vol. 6, John Wiley & Sons, Ltd.

Vestal, M., Linear Time-Of-Flight Mass Spectrometry With Simultaneous Space and Velocity Focusing, U.S. Appl. No. 12/968,254, filed Dec. 14, 2010.

"Notification of Transmittal of the International Search Report and the Written Opinion of the International Searching Authority, or the Declaration" for PCT/US2010/022122, Aug. 16, 2010, 9 pages, International Searching Authority, Korean Intellectual Property Office, Seo-gu, Daejeon, Republic of Korea.

"Notification Concerning Transmittal of International Preliminary Report on Patentability (Chapter I of the Patent Cooperation Treaty)" for PCT/US2009/045108, Dec. 9, 2010, 9 pages, The International Bureau of WIPO, Geneva, Switzerland.

"Notification of Transmittal of the International Search Report and the Written Opinion of the International Searching Authority, or the Declaration" for PCT/US2010/046074, Apr. 15, 2011, 8 pages, International Searching Authority, Korean Intellectual Property Office, Seo-gu, Daejeon, Republic of Korea.

"Notification of Transmittal of the International Search Report and the Written Opinion of the International Searching Authority, or the Declaration" for PCT/US2010/036501, Jan. 4, 2011, 9 pages, International Searching Authority, Korean Intellectual Property Office, Seo-gu, Daejeon, Republic of Korea.

"Notification Concerning Transmittal of International Preliminary Report on Patentability (Chapter I of the Patent Cooperation Treaty)" for PCT/US2010/046074, Mar. 8, 2012, 5 pages, The International Bureau of WIPO, Geneva, Switzerland.

* cited by examiner

TIME-OF-FLIGHT MASS SPECTROMETER WITH ION SOURCE AND ION DETECTOR ELECTRICALLY CONNECTED

CROSS REFERENCE TO RELATED APPLICATION SECTION

The present application claims priority to U.S. Provisional Patent Application No. 61/792,083, filed on Mar. 15, 2013, entitled "Time-Of-Flight Mass Spectrometer with Both Ion Source Input and Signal Output at Ground Potential." The entire content of U.S. Provisional Patent Application No. 61/792,083 is herein incorporated by reference.

The section headings used herein are for organizational purposes only and should not to be construed as limiting the subject matter described in the present application in any way.

INTRODUCTION

Time-of-Flight (TOF) mass spectrometers are well known in the art. Wiley and McLaren described the theory and operation of TOF mass spectrometers more than 50 years ago. See W. C. Wiley and I. H. McLaren, "Time-of-Flight Mass Spectrometer with Improved Resolution", Rev. Sci. Instrum. 26, 1150-1157 (1955). During the first two decades after the discovery of the TOF mass spectrometry, TOF mass spectrometer instruments were generally considered a useful tool for exotic studies of ion properties, but were not widely used to solve analytical problems.

Numerous more recent discoveries, such as the discovery of naturally pulsed ion sources (e.g. plasma desorption ion source), static Secondary Ion Mass Spectrometry (SIMS), and Matrix-Assisted Laser Desorption/Ionization (MALDI) has led to renewed interest in TOF mass spectrometer technology. See, for example, R. J. Cotter, "Time-of-Flight Mass Spectrometry: Instrumentation and Applications in Biological Research," American Chemical Society, Washington, D.C. (1997) for a description of the history, development, and applications of TOF-MS in biological research.

More recently, work has focused on developing new and improved TOF instruments and software that allow the full potential mass resolution of MALDI to be applied to difficult biological analysis problems. The discoveries of electrospray (ESI) and MALDI removed the volatility barrier for mass spectrometry. Electrospray mass spectrometers developed very rapidly, at least in part due to the ease in which these instruments interface with commercially available quadrupole and ion trap instruments that were widely employed for many analytical applications. Applications of MALDI to TOF instruments have developed more slowly, but the potential of MALDI has stimulated development of improved TOF instrumentations that are specifically designed for MALDI ionization techniques.

Recently, matrix assisted laser desorption/ionization time-of-fight mass (MALDI-TOF) spectrometry has become an established technique for analyzing a variety of nonvolatile molecules including proteins, peptides, oligonucleotides, lipids, glycans, and other molecules of biological importance. While MALDI TOF spectrometry technology has been applied to many analytical applications, widespread acceptance has been limited by many factors including, for example, the cost and complexity of these instruments, relatively poor reliability, and insufficient performance, such as insufficient speed, sensitivity, resolution, and mass accuracy.

Different types of TOF analyzers are required for different analytical applications depending on the properties of the molecules to be analyzed. For example, a simple linear analyzer is preferred for analyzing high mass ions, such as intact proteins, oligonucleotides, and large glycans, while a reflecting analyzer is required to achieve sufficient resolving power and mass accuracy for analyzing peptides and small molecules. Determining the molecular structure by MS-MS techniques requires yet another analyzer. In some commercial instruments, all of these types of analyzers are combined in a single instrument. Such combined instruments have the advantage of reducing the cost somewhat relative to owning and operating three separate instruments. However, these combined instruments have the disadvantage of there being a substantial increase in instrument complexity, a reduction in reliability, and other compromises which make the performance of all of the analyzers less than optimal.

BRIEF DESCRIPTION OF THE DRAWINGS

The present teaching, in accordance with preferred and exemplary embodiments, together with further advantages thereof, is more particularly described in the following detailed description, taken in conjunction with the accompanying drawings. The skilled person in the art will understand that the drawings, described below, are for illustration purposes only. The drawings are not necessarily to scale, emphasis instead generally being placed upon illustrating principles of the teaching. The drawings are not intended to limit the scope of the Applicant's teaching in any way.

DESCRIPTION OF VARIOUS EMBODIMENTS

Reference in the specification to "one embodiment" or "an embodiment" means that a particular feature, structure, or characteristic described in connection with the embodiment is included in at least one embodiment of the teaching. The appearances of the phrase "in one embodiment" in various places in the specification are not necessarily all referring to the same embodiment.

It should be understood that the individual steps of the methods of the present teachings may be performed in any order and/or simultaneously as long as the teaching remains operable. Furthermore, it should be understood that the apparatus and methods of the present teachings can include any number or all of the described embodiments as long as the teaching remains operable.

The present teaching will now be described in more detail with reference to exemplary embodiments thereof as shown in the accompanying drawings. While the present teachings are described in conjunction with various embodiments and examples, it is not intended that the present teachings be limited to such embodiments. On the contrary, the present teachings encompass various alternatives, modifications and equivalents, as will be appreciated by those of skill in the art. Those of ordinary skill in the art having access to the teaching herein will recognize additional implementations, modifications, and embodiments, as well as other fields of use, which are within the scope of the present disclosure as described herein.

Many analytical applications, such as tissue imaging and biomarker discovery require measurements on intact proteins over a very broad mass range. For these applications, mass range, mass sensitivity over a broad mass range, speed of analysis, reliability, and the ease-of-use of the instrument are more important metrics than the instrument's resolving power. One aspect of the present teaching is a mass spectrometer that provides optimum performance for these and similar applications that is more reliable, easier to use, and less expensive.

A typical MALDI-TOF mass spectrometer comprises a MALDI sample plate for supporting the sample in a vacuum housing. A pulsed ion source is located in a source housing where a pulse of energy, such as a laser pulse, is directed to the sample plate to ionize the MALDI sample producing a pulse of ions that separate according to their mass-to-charge ratios in the TOF analyzer. A vacuum generator maintains a high vacuum in the source housing and in the analyzer housings. A high voltage generator applies a high voltage to the sample plate in order to accelerate the ions. An ion detector detects the pulse of ions.

Figure 1:
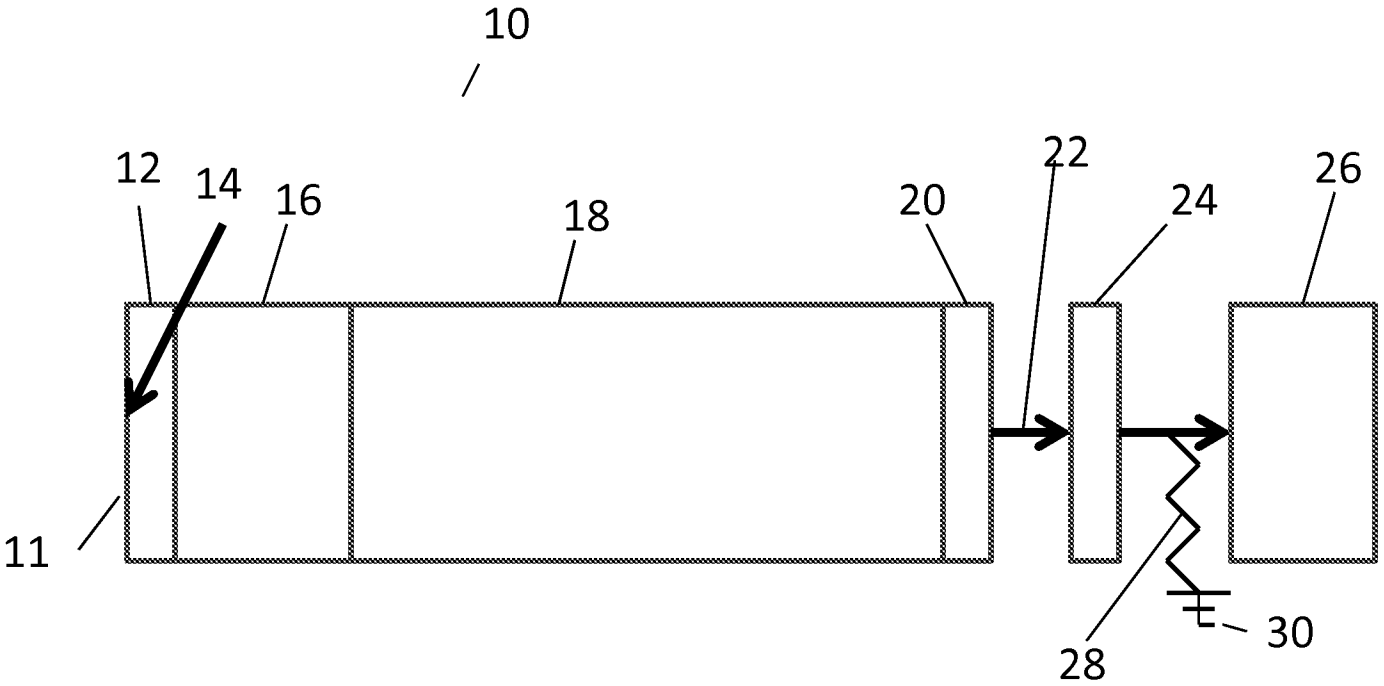
FIG. 1 Prior Art
FIG. 1 illustrates a block diagram of a prior art time-of-flight mass spectrometer that can perform MALDI-TOF spectrometry.

FIG. 1 illustrates a block diagram of a prior art time-of-flight (TOF) mass spectrometer 10 that can perform MALDI-TOF spectrometry. The TOF mass spectrometer 10 includes a MALDI sample plate 11 for supporting a MALDI sample in a vacuum housing. A pulsed ion source 12 is positioned to apply a pulse of energy 14 to the sample plate 11 so as to generate a pulse of ions. An ion accelerator 16 is positioned proximate to the sample plate 11 so that ions entering the ion accelerator 16 are accelerated into an evacuated drift space 18 to an ion detector 20.

The ion detector 20 produces a pulse of electrons 22 in response to the arrival of the pulse of ions generated by the pulsed ion source 12. An electronic recording device 26 is used to acquiring the time-of-flight spectrum. The time between generating the pulse of ions with the pulsed ion source 12 and generating the pulse of electrons 22 corresponds to the time required for ions to travel from the pulsed ion source 12 to the ion detector 20. This time depends on the mass-to-charge ratio and on the kinetic energy of the ions. The relationship between time, mass-to-charge ratio, and the kinetic energy of the ions is described by equations that are well known in the art. The resulting time-of-flight spectrum is calibrated to produce a spectrum of mass-to-charge ratios of the ions produced and detected.

In many prior art TOF mass spectrometers, the pulsed ion source 12 is electrically isolated from the ion detector output pulse 22. There is typically a very large potential difference between the pulsed ion source 12 and the output of the ion detector output. In such prior art mass spectrometers, at least one of the ion source 12 and the ion detector output 22 is typically isolated from ground potential.

The ion detector 20 is electrically connected to the time-of-flight mass spectrum recording device 26. In many prior art systems, the time-of-flight mass spectrum recording device 26 is referenced to ground through resistor 28. In spectrometers where the detector output 22 is isolated from ground potential, an electronic coupling device 24 is typically coupled between the ion detector 20 and the recording device 26 to transmit the pulse of electrons to the grounded input of the recording device 26.

The electronic recording devices are typically electrically connected to at least one computer that is operated by a technician. For safety, and other practical reasons, these electronic devices and computers, which are operated by technicians, are at ground potential. The MALDI sample plate 11, however, is necessarily biased at a very high electrical potential, which is often 30 kV or more relative to ground potential. The apparatuses required for introducing the sample plate 11 into the ion source vacuum housing are designed to provide high voltage isolation of the sample plate 11 in order to protect the user. Providing the required electrical high voltage isolation significantly increases the cost of the instrument. Furthermore, the required electrical high voltage isolation significantly lowers the reliability and thus increases the probability of a failure compared to operating the sample plate at ground potential, since high voltage breakdowns frequently occur and these high voltage breakdowns often damage the instrument.

Figure 2:
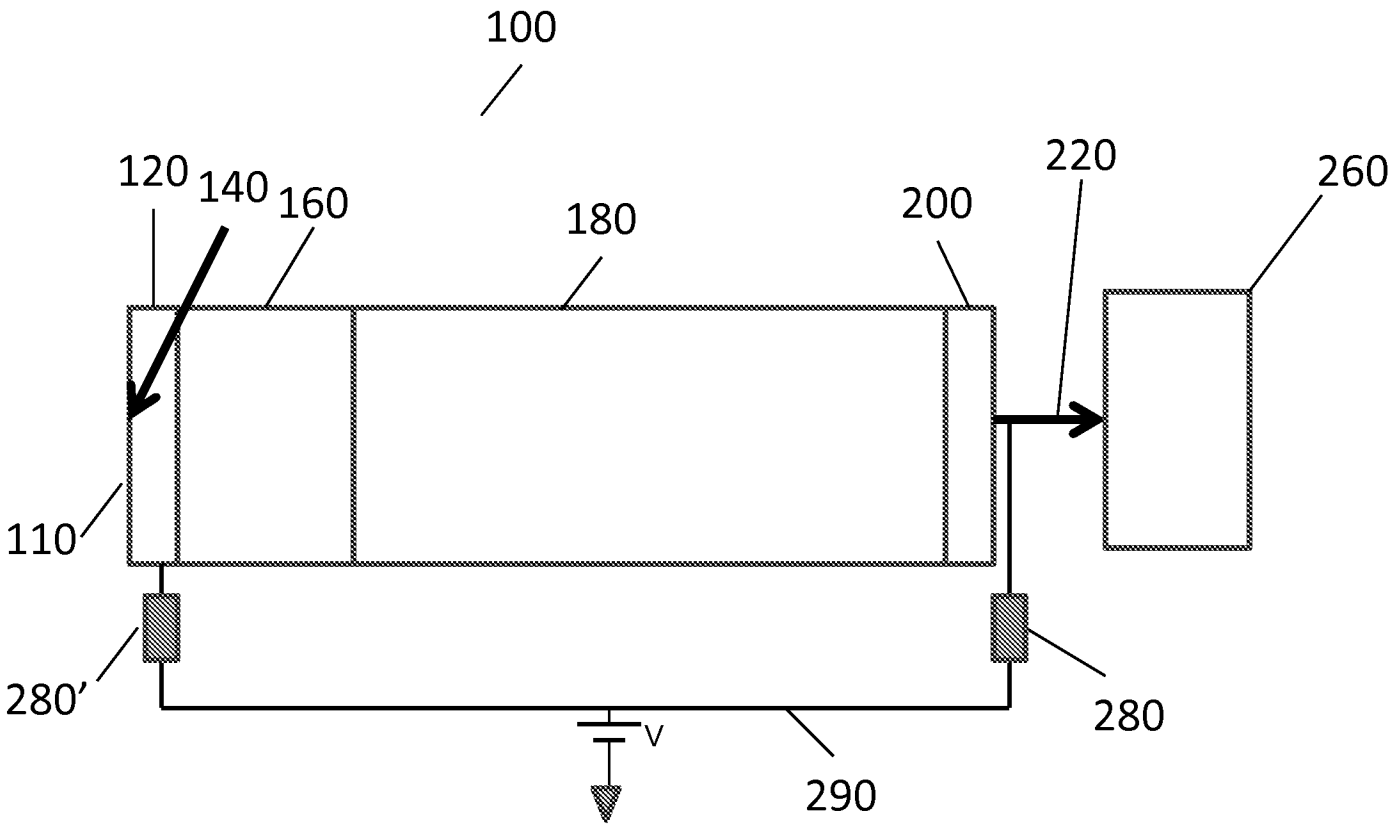
FIG. 2 is a block diagram of one embodiment of a time-of-flight mass spectrometer according to the present teaching.

FIG. 2 is a block diagram of one embodiment of a time-of-flight mass spectrometer 100 according to the present teaching. The TOF mass spectrometer 100 is similar to the TOF mass spectrometer 10 described in connection with FIG. 1 and has a geometry that is similar to the linear TOF mass spectrometer geometry described in U.S. Pat. No. 7,564,026, which is assigned to the present assignee. The entire contents of 7,564,026 are incorporated herein by reference. The TOF mass spectrometer includes a MALDI sample plate 110 for supporting a MALDI sample in a vacuum housing. A pulsed ion source 120 is positioned to apply a pulse of energy 140 to the sample plate 110 so as to generate a pulse of ions. An ion accelerator 160 is positioned proximate to the sample plate 110 so that ions entering the ion accelerator 160 are accelerated and travel into an evacuated drift space 180 and then to an ion detector 200. The ion detector 200 produces a pulse of electrons 220 in response to the arrival of a pulse of ions generated by the pulsed ion source 120. A recording device 260 is used to record the arrival of the pulses of ions and to form the time-of-flight spectrum.

In various embodiments of the present teaching, the sample plate 110 is electrically connected to the output of the ion detector 200 and to the recording device 260 either directly or through one or more resistors 280, 280'. In one embodiment, the sample plate 110 and the ion detector 200 output are at a common electrical potential. In this embodiment, resistors 280 and 280' are either very low resistance resistors or are replaced with low resistance electrical connectors so that the ion source 120 is directly connected to the ion detector 200 output. The common electrical potential can be ground potential. However, it is understood that the present teaching includes configurations where the common electrical potential of the sample plate 110 and the ion detector 200 output are all substantially at a common potential relative to ground potential, but not at ground potential. This common potential can be any positive or negative potential. This configuration has some advantages because many recording devices are designed to be grounded for operator safety.

In another embodiment of the present teaching, the pulsed sample plate 110 is electrically connected to the output of the ion detector 200 by at least one of the resistors 280, 280' as shown in FIG. 2. For example, the output of the ion detector 200 can be electrically connected to the common potential through the resistor 280 and the sample plate 110 can be electrically connected to the common potential with the resistor 280' as shown in FIG. 2. Alternatively, the output of the ion detector 200 can be electrically connected to the common potential through the resistor 280 and the sample plate 110 can be directly connected to the common potential with the resistor 280' in FIG. 2 replaced by a low resistance electrical connection. Also, the output of the ion detector 200 can be directly connected to the common potential with the resistor 280 replaced by a low resistance electrical connection and the sample plate 110 can be directly connected to the common potential with the resistor 280'.

The operation of the TOF mass spectrometer 100 according to the present teaching is similar to the operation of the TOF mass spectrometer 10 described in connection with FIG. 1 in that the time between the generation of the pulse of ions with the pulsed ion source 120 and the generation of the pulse of electrons 220 corresponds to the time required for ions to travel from the pulsed ion source 120 to the ion detector 200. Thus, the resulting time-of-flight spectrum can be calibrated to produce a spectrum of mass-to-charge ratios of the ions produced and detected.

In one aspect of the present teaching, the pulsed ion source 120 including the sample plate 110 is biased at an electrical potential that is substantially identical to the electrical potential of the ion detector 200 output. In many embodiments, the recording device 260 that records the time-of-flight spectrum is also biased at substantially the same potential as the sample plate 110 and pulsed ion source 120 and the ion detector 200 output through the resistor 280. In one specific embodiment, the pulsed ion source 120, the output of the ion detector 200, and the recording device 260 are all at a common potential 290, which can be ground potential. However, it is understood that the present teaching includes configurations and methods of operation where the electrical potential of the pulsed ion source 120, including the sample plate 110, the ion detector 200 output, and the recording device 260 are all substantially at a common potential relative to ground potential, but not at ground potential. This common potential can be any positive or negative potential. In various other configurations and methods of operation, the pulsed ion source 120, including the sample plate 110 and the ion detector 200 output are electrically connected through at least one resistor forming a potential difference between these components during operation.

Figure 3:
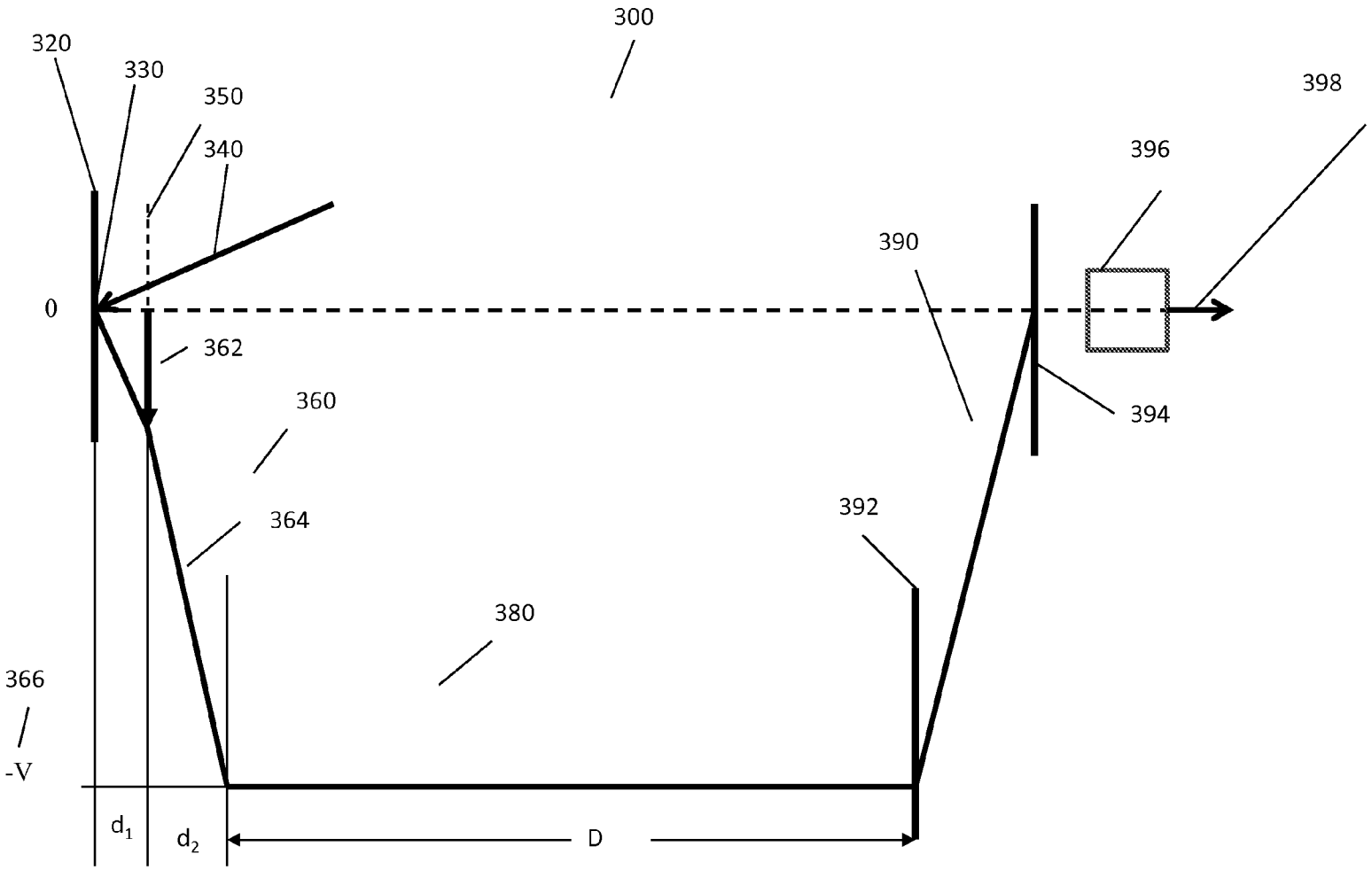
FIG. 3 is a potential diagram for a linear time-of-flight mass spectrometer according to one embodiment of the present teaching.

FIG. 3 is a potential diagram 300 for a linear time-of-flight mass spectrometer according to one embodiment of the present teaching. Referring to both the potential diagram 300 and to the block diagram of the time-of-flight mass spectrometer 100 described in connection with FIG. 2, a sample plate 320 with a sample for analysis 330 is at ground potential, but one skilled in the art will appreciate that the sample plate 320 can be at other potentials as described herein. A pulse of energy 340, such as a laser pulse, impinges on the sample for analysis 330 positioned on the sample plate 320 and produces a pulse of ions during impact. The pulse of ions is accelerated by an accelerating field 360. In one particular embodiment, the accelerating field 360 comprises a pulsed acceleration voltage 362 that is applied to the extraction electrode 350 and a static acceleration field 364 that produces ions with a kinetic energy eV corresponding to an acceleration to potential −V 366. The pulse of ions travels through an evacuated field-free region 380 and then strikes an ion detector 392, which converts the pulse of ions to a pulse of electrons.

The pulse of electrons is then accelerated to energy eV by an accelerating field 390. The accelerated pulse of electrons then impinges on the electron detector 394 that converts the pulse of electrons into a pulse of light. The pulse of light impinges on the input of photon detector 396 that converts the pulse of light to a second pulse of electrons 398 that is representative of the detected ions. The second pulse of electrons is referenced to ground potential. The time interval between the second pulse of electrons 398 and the pulsed source of 340 is recorded and the mass/charge ratio of detected ions is determined from the time interval using equations known in the art.

One skilled in the art will appreciate that there are many variations of the time-of-flight mass spectrometer according to the present teaching. In various embodiments, additional elements such as ion mirrors, ion deflectors, ion lenses, timed-ion selectors, and pulsed accelerators can be included in the evacuated drift space 180 (FIG. 2) to improve the resolution of mass spectra generated or to provide additional information about the ions analyzed.

Figure 4:
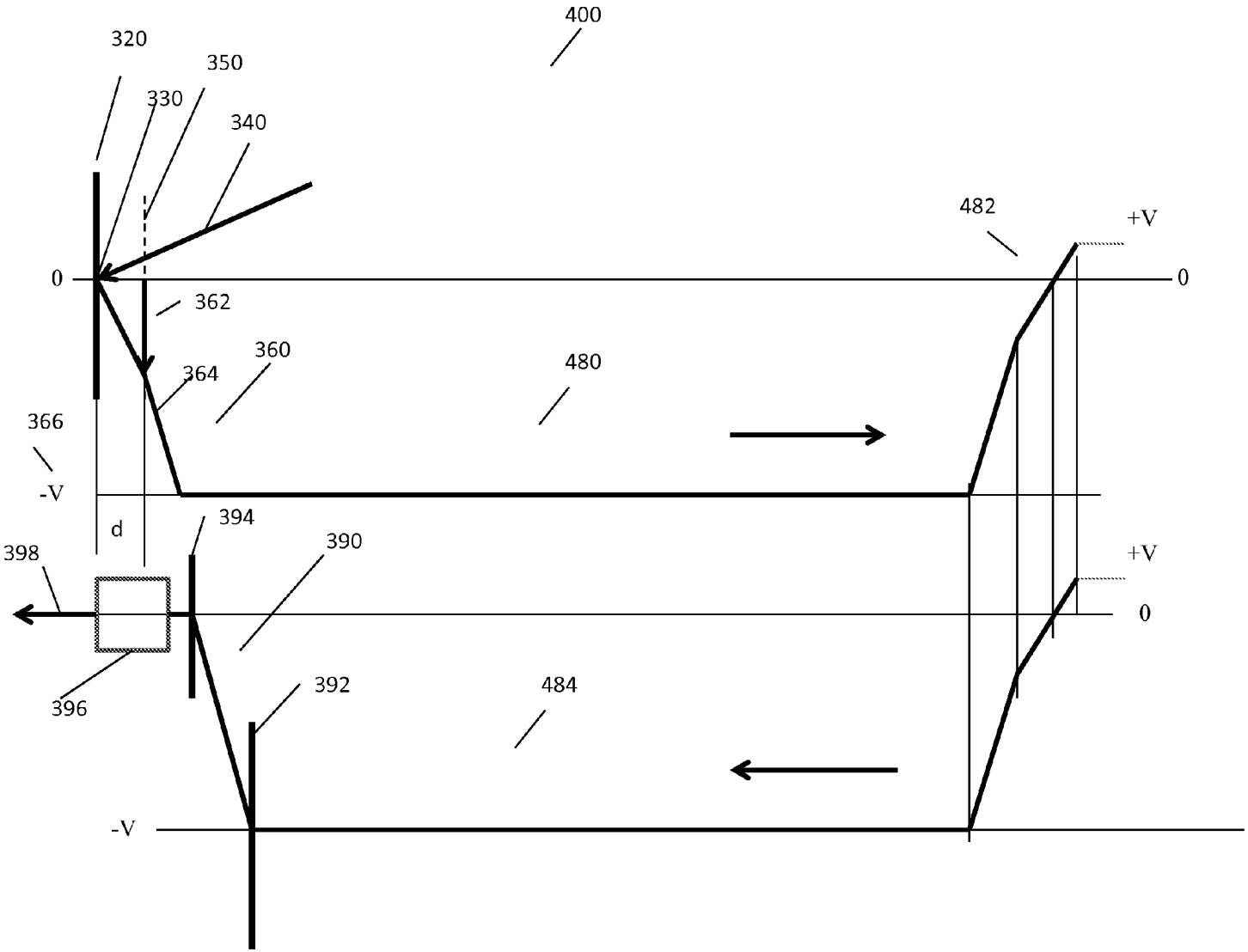
FIG. 4 is a potential diagram of a reflecting time-of-flight mass spectrometer that includes an ion mirror according to one embodiment of the present teaching.

FIG. 4 is a potential diagram 400 of a reflecting time-of-flight mass spectrometer that includes an ion mirror according to one embodiment of the present teaching. In this embodiment, a sample plate 320 with samples for analysis 330 is at ground potential, but one skilled in the art will appreciate that the sample plate 320 can be at other potentials as described herein. A pulse of energy 340, such as a pulse of light from a laser, impinges on the sample plate 320, thereby producing a pulse of ions during impact. The pulse of ions is accelerated by the accelerating field 360. In one particular embodiment, the accelerating field 360 is generated by a pulsed acceleration voltage 362 that is applied to extraction electrode 350 and a static acceleration voltage 364 that produces ions with kinetic energy eV corresponding to accelerating potential −V 366.

The pulse of ions travels through the first field-free evacuated region 480, and is reflected by ion mirror 482. Ion mirrors, which are sometimes called ion reflectors, are well known in the art. Ion mirrors generate one or more retarding, electrostatic fields that compensate for the effects of the initial kinetic energy distribution of the ions. As the ions penetrate the ion mirror they are decelerated until the velocity component of the ions in the direction of the electric field becomes zero. Then, the ions reverse direction and are accelerated back through the ion mirror. The ions exit the first ion mirror with energies that are identical or nearly identical to their incoming energy, but with velocities that are in the opposite direction. Ions with larger energies penetrate the ion mirror more deeply and, consequently, will remain in the ion mirror for a longer time. In a properly designed ion mirror, the potentials are selected to modify the flight paths of the ions such that the travel time between the focal points of the ion mirror for ions of like mass and charge is independent of their initial energy.

The ions reflected by the ion mirror 482 then travel through a second field-free evacuated region 484 where they strike the ion detector 392 that converts the pulse of ions into a pulse of electrons. The pulse of electrons is then accelerated to energy eV by the accelerating field 390. The accelerated pulse of electrons then impinges on the electron detector 394 that converts the pulse of electrons into a pulse of light. The pulse of light impinges on the input of an optical detector, such as a photon detector 396, which converts the pulse of light into a second pulse of electrons 398, having an amplitude that is proportional to the number of detected ions. In one embodiment of the present teaching, the second pulse of electrons 398 is referenced to the potential of the sample plate 320, which is ground potential in one particular embodiment of the present teaching, but which can be at any potential. In other embodiments, the second pulse of electrons 398 is referenced to another potential that is common with the potential of the sample plate 320. The time interval between the generation of the second pulse of electrons 398 and the generation of the pulse of energy 340 is recorded and the mass/charge ratio of detected ions is determined from the time interval using equations known in the art.

Figure 5:
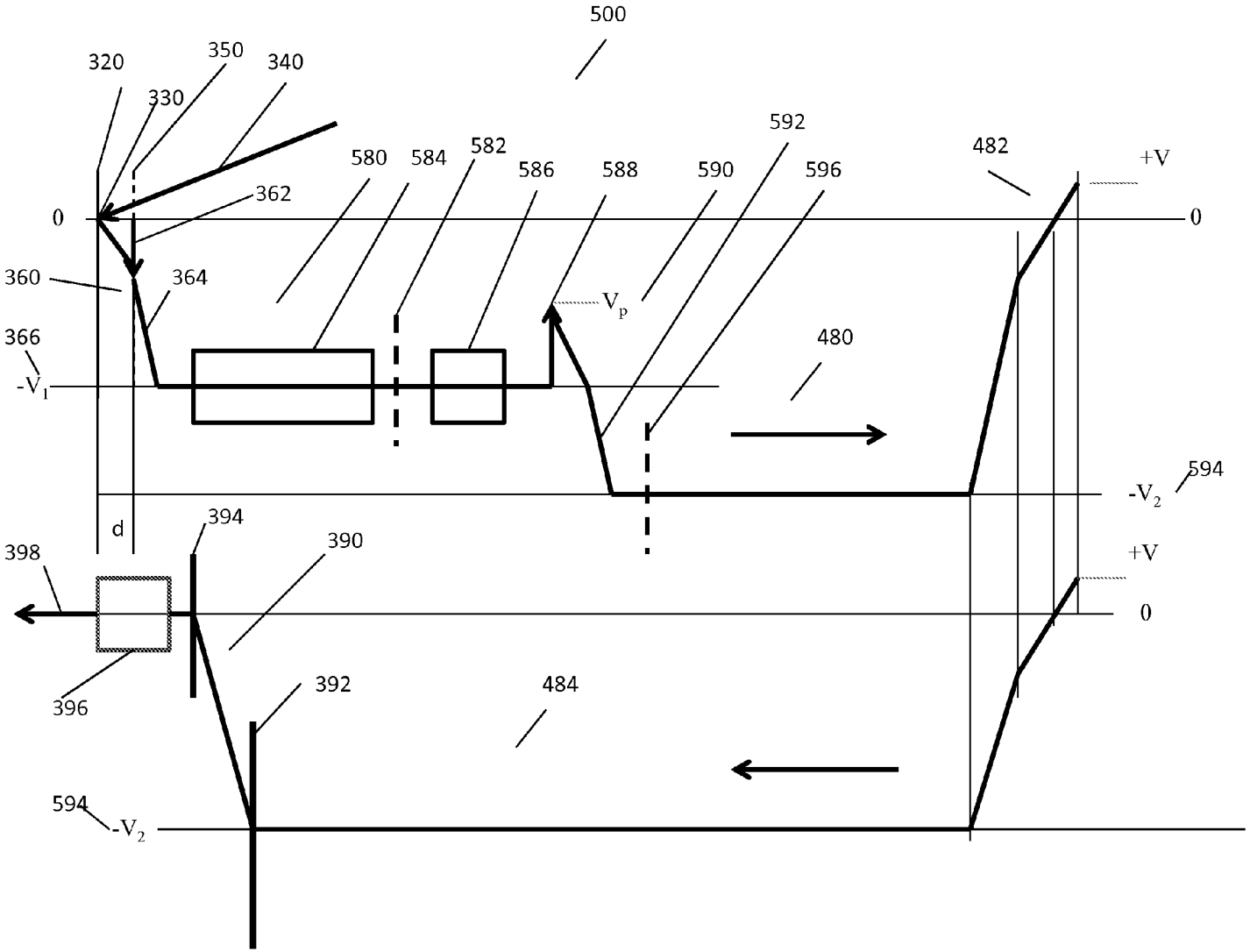
FIG. 5 is a potential diagram for one embodiment of a tandem time-of-flight mass spectrometer according to the present teaching.

FIG. 5 is a potential diagram 500 for one embodiment of a tandem time-of-flight mass spectrometer according to the present teaching. In this embodiment, a sample plate 320 with samples for analysis 330 is at ground potential, but one skilled in the art will appreciate that the sample plate 320 can be at other potentials as described herein. A pulse of energy 340, such as a laser pulse, impinges on the sample plate 320, thereby producing a pulse of ions during impact. The pulse of ions is accelerated by the first accelerating field 360. In one specific embodiment, the first accelerating voltage 360 comprises a pulsed acceleration voltage 362 that is applied to the extraction electrode 350 and a static acceleration potential 364, which produces ions with kinetic energy $eV_1$ that correspond to an acceleration potential $-V_1$ 366.

The pulse of ions travel through a first field-free evacuated region 580 that includes a timed-ion-selector 582 and then through fragmentation chambers 584 and 586. The first field-free evacuated region 580 is terminated by the accelerator pulse 588 which further accelerates with a pulsed acceleration voltage $V_p$ 590 and static accelerator voltage 592 to potential $-V_2$ 594 in the second field-free evacuated region 480. The pulse of ions is reflected by the ion mirror 482 to the third field-free evacuated region 484 and strikes the ion detector 392 that converts the pulse of ions to a pulse of electrons. The pulse of electrons is then accelerated to energy eV by voltage 390.

The pulse of electrons then impinges on the electron detector 394 that converts the pulse of electrons to a pulse of light. The pulse of light impinges on the input of photon detector 396 where the photo detector 396 converts the pulse of light to a pulse of electrons 398 wherein the pulse of electrons 398 is referenced to ground potential. The time interval between the pulse of electrons 398 and the pulsed source of energy 340 is recorded and the mass/charge ratio of detected ions is determined from the time interval using equations known in the art.

Figure 6:
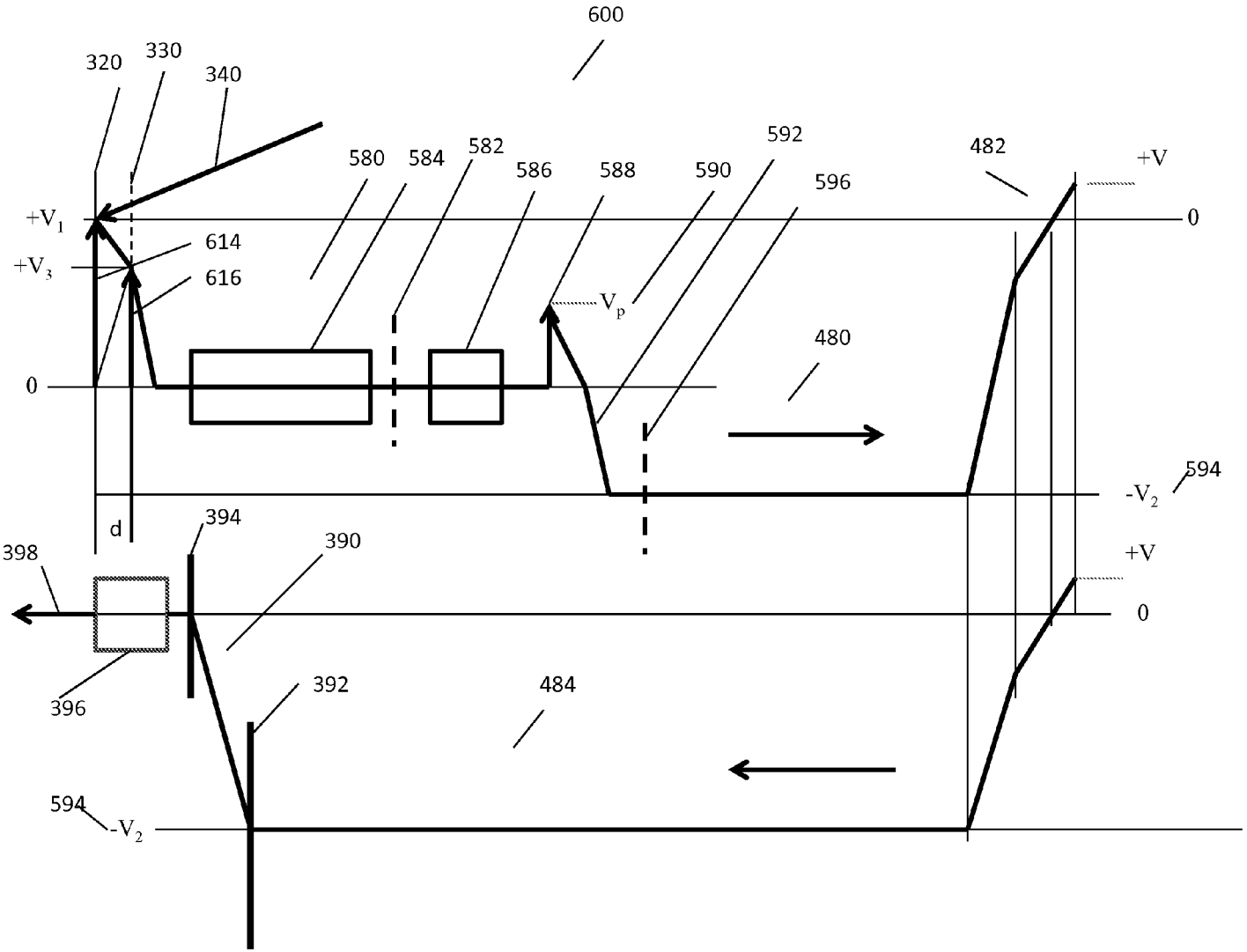
FIG. 6 illustrates a potential diagram for another embodiment of a tandem time-of-flight mass spectrometer according to the present teaching.

FIG. 6 illustrates a potential diagram 600 for another embodiment of a tandem time-of-flight mass spectrometer according to the present teaching. In this embodiment, a sample plate 320 with samples for analysis is electrically connected to ground potential. A pulsed source of energy 340 impinges on sample plate 320 producing a pulse of ions that is accelerated by the first accelerating voltage 616. In one specific embodiment, a positive pulse of amplitude $+V_1$ 614 is applied to sample plate 320 and a positive pulse of amplitude $+V_3$ 616 is applied to extraction electrode 330 in order to accelerate ions to kinetic energy $eV_1$ at ground potential in first evacuated field-free region 580. The pulse of ions travels through the first evacuated field-free region 580 at ground potential. The first evacuated field-free region 580 comprises first timed-ion-selector 582 and the fragmentation chambers 584 and 586. The first evacuated field-free region 580 is terminated by accelerator 588 that further accelerates by pulsed accelerator $V_p$ 590 and static accelerator 592 to potential $-V_2$ 594 in the second evacuated field-free region 480. The pulse of ions is reflected by ion mirror 482 to the third evacuated field-free region 484 where it then strikes ion detector 392, which converts the pulse of ions to a pulse of electrons.

The pulse of electrons is then accelerated to energy eV by the electric field 390 and consequently impinges on electron detector 394 that converts the pulse of electrons to a pulse of light. The pulse of light impinges on the input of photon detector 396 that converts the pulse of light to a pulse of electrons 398. The pulse of electrons 398 is referenced to ground potential. The time interval between the pulse of electrons 398 and the pulsed source of energy 340 is recorded. The mass/charge ratio of the detected ions is determined from the time interval using equations that are well known in the art.

In operation, a pulse of ions is produced by a pulsed ion accelerator. The first timed ion selector 582 selects a group of ions with predetermined values of mass-to-charge ratio. The pulse of ions is fragmented in fragmentation chambers 584 and 586. The timed ion selector 582 directs the selected ions and fragments thereof to the pulsed ion accelerator 590 and deflects all other ions away. The pulsed ion accelerator 590 accelerates the ions and their corresponding fragments exiting the ion fragmentation chamber 586 to potential $-V_2$ 594, which is applied to the second field-free drift space 480. The ion mirror 482 reflects the accelerated ions and then directs them through the third evacuated field-free drift space 484 to the ion detector 392 where they are detected and processed by a digital processor (not shown). The processor can be used for interpreting the fragment ion mass spectrum to simultaneously identify molecules of interest.

In some embodiments, the second evacuated field-free region 480 further comprises a second timed ion selector 596 that, when energized, transmits a selected portion of the fragment spectrum from each selected precursor mass and rejects all others.

EQUIVALENTS

While the Applicant's teaching is described in conjunction with various embodiments, it is not intended that the Applicant's teaching be limited to such embodiments. On the contrary, the Applicant's teaching encompass various alternatives, modifications, and equivalents, as will be appreciated by those of skill in the art, which may be made therein without departing from the spirit and scope of the teaching.

What is claimed is:

1. A time-of-flight mass spectrometer comprising:

a. a sample plate that supports a sample for analysis;

b. a pulsed ion source that generates a pulse of ions from the sample positioned on the sample plate;

c. an ion accelerator having an input that receives the pulse of ions generated by the pulsed ion source, the ion accelerator accelerating the pulse of ions; and d. an ion detector having an input in a flight path of the accelerated ions emerging from the ion accelerator and having an output that is electrically connected to sample plate, the ion detector converting the detected ions into a pulse of electrons.

2. The spectrometer of claim 1 wherein both the output of the ion detector and the sample plate are electrically connected to a common potential.

3. The spectrometer of claim 2 wherein the common potential is ground potential.

4. The spectrometer of claim 2 wherein the common potential is a positive voltage.

5. The spectrometer of claim 2 wherein the common potential is a negative voltage.

6. The spectrometer of claim 2 wherein one of the output of the ion detector and the sample plate is electrically connected to the common potential through a resistor and the other one of the output of the ion detector and the sample plate is directly connected to the common potential.

7. The spectrometer of claim 2 wherein the output of the ion detector is electrically connected to the common potential through a first resistor and the sample plate is electrically connected to the common potential through a second resistor.

8. The spectrometer of claim 2 further comprising a recording device having an input that is electrically connected to the output of the detector and being electrically connected to the common potential.

9. The spectrometer of claim 1 wherein the sample plate comprises a MALDI sample plate.

10. The spectrometer of claim 1 wherein the pulsed ion source comprises a pulsed laser source that directs a pulse of light to the sample on the sample plate, thereby ionizing a pulse of sample material.

11. The spectrometer of claim 1 further comprising a field-free region between the ion accelerator and the ion detector.

12. The spectrometer of claim 1 wherein the ion accelerator comprises a pulsed ion accelerator that generates a static acceleration field and a pulsed accelerating field which accelerate the pulse of ions.

13. The spectrometer of claim 1 wherein the ion detector comprises:

a) an ion detector that converts the pulse of ions into a first pulse of electrons;

b) an electrode that generates an accelerating field which accelerates the first pulse of electrons;

c) an electron detector that converts the first pulse of electrons into a pulse of light; and d) an optical detector that converts the pulse of light into a second pulse of electrons having an amplitude that is proportional to the number of detected ions.

14. A tandem time-of-flight mass spectrometer comprising:

a) a sample plate that supports a sample for analysis;

b) a pulsed ion source that generates a pulse of ions from the sample positioned on the sample plate;

c) an ion accelerator having an input that receives the pulse of ions generated by the pulsed ion source, the ion accelerator accelerating the pulse of ions;

d) an ion mirror having an input that receives the accelerated ions, the ion mirror generating one or more retarding electrostatic fields that at least partially compensate for the effects of the initial kinetic energy distribution of the accelerated ions; and e) an ion detector having an input that receives the reflected ions emerging from the ion mirror and having an output that is electrically connected to the sample plate, the ion detector converting the detected ions into a pulse of electrons.

15. The spectrometer of claim 14 wherein both the output of the ion detector and the sample plate are electrically connected to a common potential.

16. The spectrometer of claim 15 wherein the common potential is ground potential.

17. The spectrometer of claim 15 wherein the common potential is a positive voltage.

18. The spectrometer of claim 15 wherein the common potential is a negative voltage.

19. The spectrometer of claim 15 wherein one of the output of the ion detector and the sample plate is electrically connected to the common potential through a resistor and the other one of the output of the ion detector and the sample plate is directly connected to the common potential.

20. The spectrometer of claim 15 wherein the output of the ion detector is electrically connected to the common potential through a first resistor and the sample plate is electrically connected to the common potential through a second resistor.

21. The spectrometer of claim 14 wherein the ion detector comprises:

a) an ion detector that converts the pulse of ions into a first pulse of electrons;

b) an electrode that generates an accelerating field which accelerates the first pulse of electrons;

c) an electron detector that converts the first pulse of electrons into a pulse of light; and d) an optical detector that converts the pulse of light into a second pulse of electrons having an amplitude that is proportional to the number of detected ions.

22. A tandem time-of-flight mass spectrometer comprising:

a) a sample plate that supports a sample for analysis;

b) a pulsed ion source that generates a pulse of ions from the sample positioned on the sample plate;

c) an ion accelerator having an input that receives the pulse of ions generated by the pulsed ion source, the ion accelerator accelerating the pulse of ions;

d) a first fragmentation chamber positioned in a field-free region in an ion path of the accelerated ions, the first fragmentation chamber fragmenting a portion of the accelerated ions;

e) a timed-ion-selector positioned in the field-free region in the ion path of the accelerated ions after the first fragmentation chamber, the timed-ion-selector selecting a portion of the fragmented ions;

f) a second fragmentation chamber positioned in the field-free region in the ion path of the accelerated ions after the timed-ion-selector, the second fragmentation chamber fragmenting the selected portion of the fragmented ions from the timed-ion-selector;

g) an ion mirror having an input that receives fragmented ions from the second fragmentation chamber, the ion mirror generating one or more retarding electrostatic fields that at least partially compensate for the effects of the initial kinetic energy distribution of the accelerated ions; and h) an ion detector having an input that receives the reflected ions emerging from the ion mirror and having an output that is electrically connected to the sample plate, the ion detector converting the detected ions into a pulse of electrons.

23. The spectrometer of claim 22 wherein both the output of the ion detector and the sample plate are electrically connected to a common potential.

24. The spectrometer of claim 23 wherein the common potential is ground potential.

25. The spectrometer of claim 23 wherein the common potential is a positive voltage.

26. The spectrometer of claim 23 wherein the common potential is a negative voltage.

27. The spectrometer of claim 23 wherein one of the ion detector and the sample plate is electrically connected to the common potential through a resistor and the other one of the output of the ion detector and the sample plate is directly connected to the common potential.

28. The spectrometer of claim 23 wherein the output of the ion detector is electrically connected to the common potential through a first resistor and the sample plate is electrically connected to the common potential through a second resistor.

* * * * *